US012038008B2

(12) United States Patent
Watanabe et al.

(10) Patent No.: US 12,038,008 B2
(45) Date of Patent: Jul. 16, 2024

(54) COMPRESSOR WITH INJECTION MECHANISM

(71) Applicant: Panasonic Intellectual Property Management Co., Ltd., Osaka (JP)

(72) Inventors: Kenji Watanabe, Shiga (JP); Akinori Fukuda, Shiga (JP); Akihiro Hayashi, Shiga (JP); Hideto Oka, Shiga (JP); Keisuke Noba, Shiga (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 17/759,955

(22) PCT Filed: Sep. 23, 2020

(86) PCT No.: PCT/JP2020/035766
§ 371 (c)(1),
(2) Date: Aug. 2, 2022

(87) PCT Pub. No.: WO2021/157121
PCT Pub. Date: Dec. 8, 2021

(65) Prior Publication Data

US 2023/0066647 A1 Mar. 2, 2023

(30) Foreign Application Priority Data

Feb. 3, 2020 (JP) ..... JP2020-016319

(51) Int. Cl.
*F03C 2/00* (2006.01)
*F03C 4/00* (2006.01)
(Continued)

(52) U.S. Cl.
CPC ..... *F04C 29/0007* (2013.01); *F04C 18/02* (2013.01); *F04C 18/0215* (2013.01); *F04C 23/008* (2013.01); *F04C 29/128* (2013.01)

(58) Field of Classification Search
CPC .. F04C 18/02; F04C 18/0215; F04C 18/0253; F04C 23/008; F04C 29/0007; F04C 29/126; F04C 29/128
See application file for complete search history.

(56) References Cited

U.S. PATENT DOCUMENTS 5,775,887 A * 7/1998 Park ..... F16K 15/162 137/856
6,202,438 B1 * 3/2001 Barito ..... F04C 29/0007 62/505
(Continued)

FOREIGN PATENT DOCUMENTS

EP 3572671 A1 * 11/2019 ..... F04C 18/0215
JP H04350377 A * 12/1992 ..... F04C 29/12
(Continued)

OTHER PUBLICATIONS

JPH04350377A-Minowa et al.-Scroll Compressor-Dec. 4, 1992-copy of the English Machine Translation. (Year: 1992).*
(Continued)

*Primary Examiner* — Theresa Trieu
(74) *Attorney, Agent, or Firm* — HSML, P.C.

(57) ABSTRACT

A sheet-shaped check valve which opens and closes the injection passage is placed in the check valve chamber, an injection discharge passage portion connected to the compression chamber of the injection passage and the check valve chamber open from an outer surface of the fixed scroll, a lid body is attached to openings of the injection discharge passage and the check valve chamber such that the check valve is sandwiched between the openings and the lid body, and the injection discharge passage and the check valve
(Continued)

chamber are hermetically closed, thereby forming the injection passage. According to this, it is possible to provide a reliable, efficient and inexpensive compressor with an injection mechanism.

4 Claims, 6 Drawing Sheets

(51) Int. Cl.

| | |
|---|---|
| ***F04C 2/00*** | (2006.01) |
| ***F04C 18/00*** | (2006.01) |
| ***F04C 18/02*** | (2006.01) |
| ***F04C 23/00*** | (2006.01) |
| ***F04C 29/00*** | (2006.01) |
| ***F04C 29/12*** | (2006.01) |

(56) References Cited

U.S. PATENT DOCUMENTS

2010/0008807 A1* 1/2010 Roof ..... F04C 18/0215 418/55.1
2017/0138361 A1 5/2017 Mizushima et al.
2019/0309750 A1* 10/2019 Nakai ..... F04C 18/0215

FOREIGN PATENT DOCUMENTS

JP H11-107950 A 4/1999
JP 2016-011620 A 1/2016
WO 2011/013199 A1 2/2011
WO 2017/130401 A1 8/2017
WO WO-2017141342 A1 * 8/2017 ..... F04C 18/02
WO 2019/202976 A1 10/2019

OTHER PUBLICATIONS

WO-2017141342-A1-MYOGAHARA et al.-Scroll Compressor-Aug. 24, 2017-copy of the English Machine Translation. (Year: 2017).*
Extended European Search Report; European patent Application No. 20917844.1; Jul. 3, 12023 (7 pages).
International Search Report and Written Opinion, International Patent Application No. PCT/JP2020/035766, with English translation of Search Report (9 pages).

* cited by examiner

[Fig. 1]
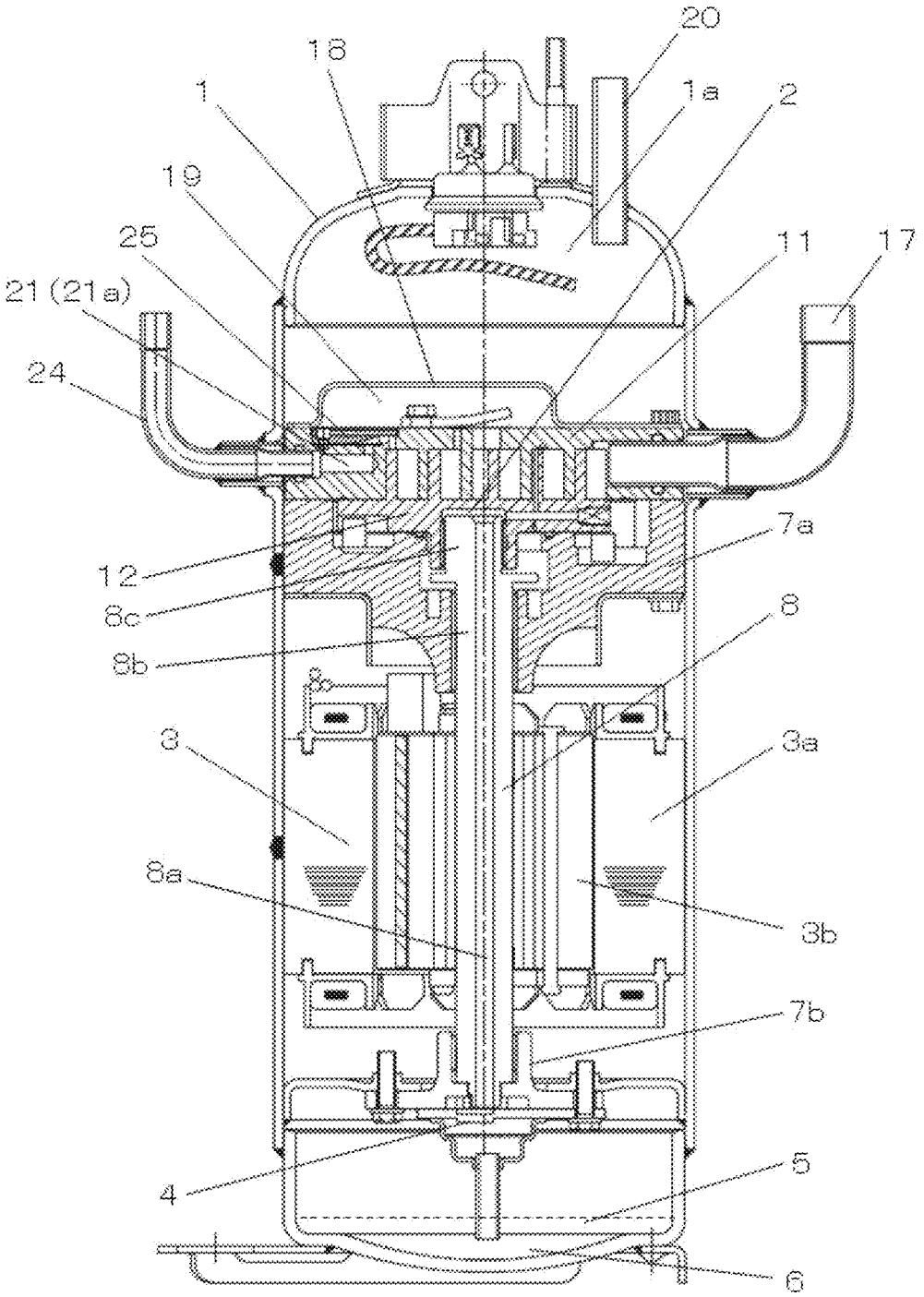

[Fig. 2]
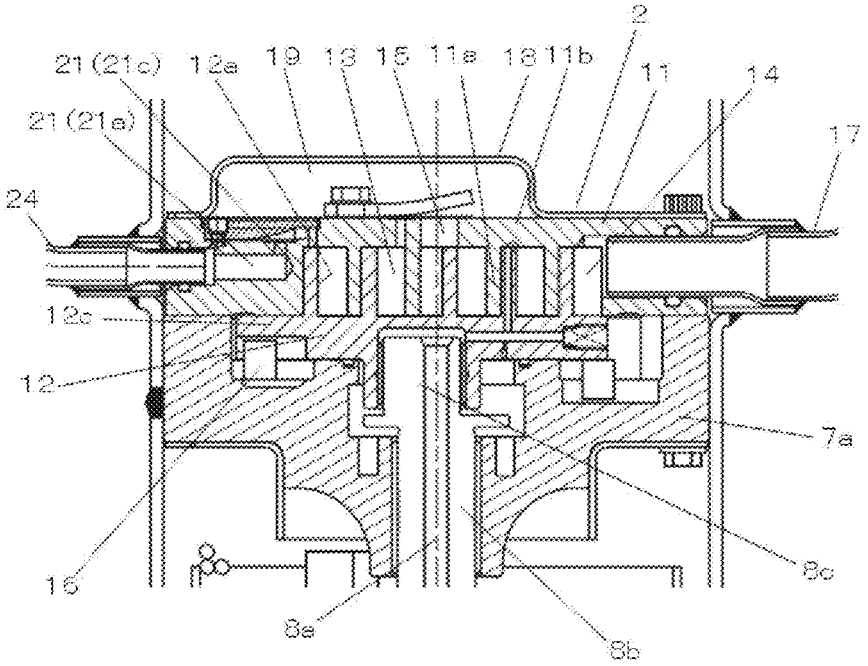

[Fig. 3]
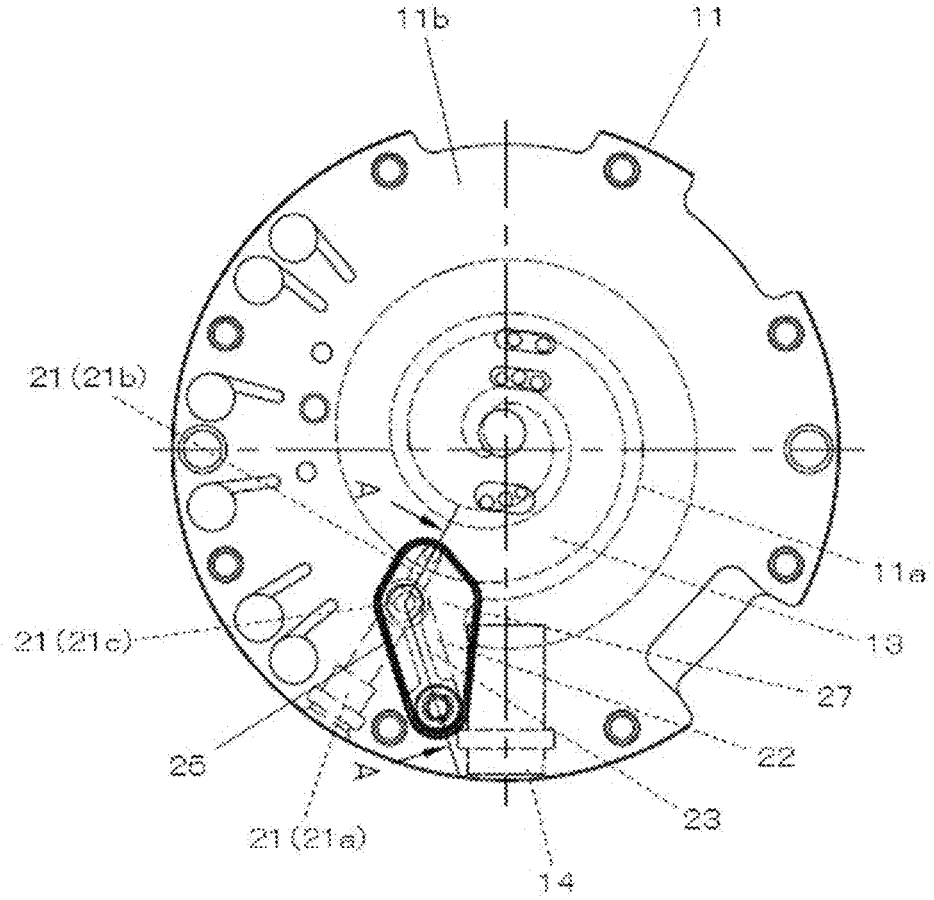
11 fixed scroll
11a blade
13 compression chamber
21 injection passage
21a injection inlet passage
21b injection discharge passage
21c injection communication passage
22 check valve chamber
23 check valve

[Fig. 4]
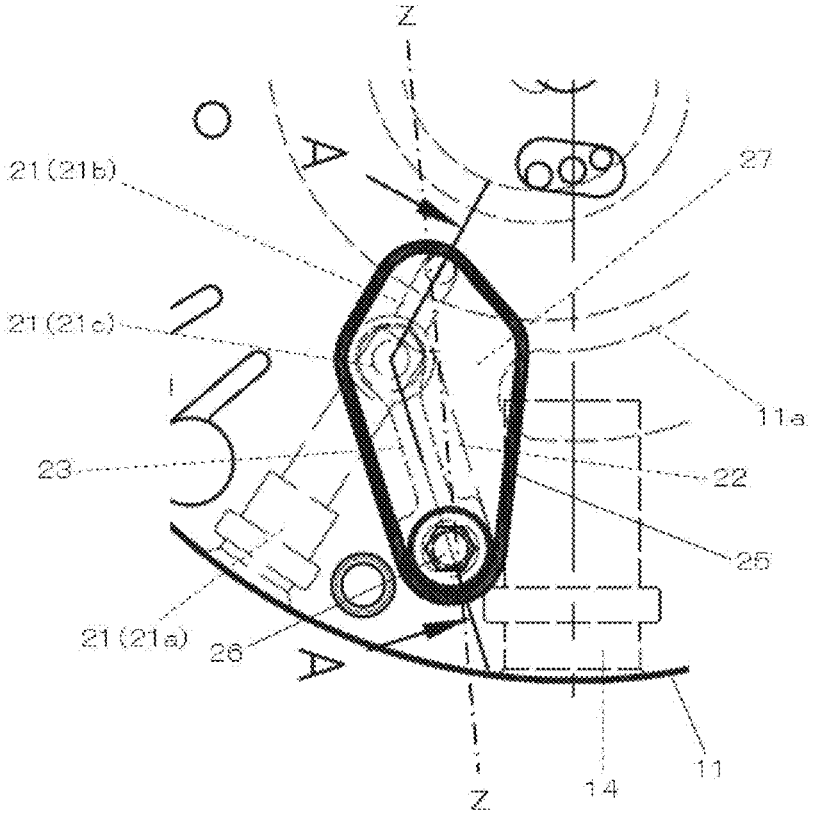

[Fig. 5]
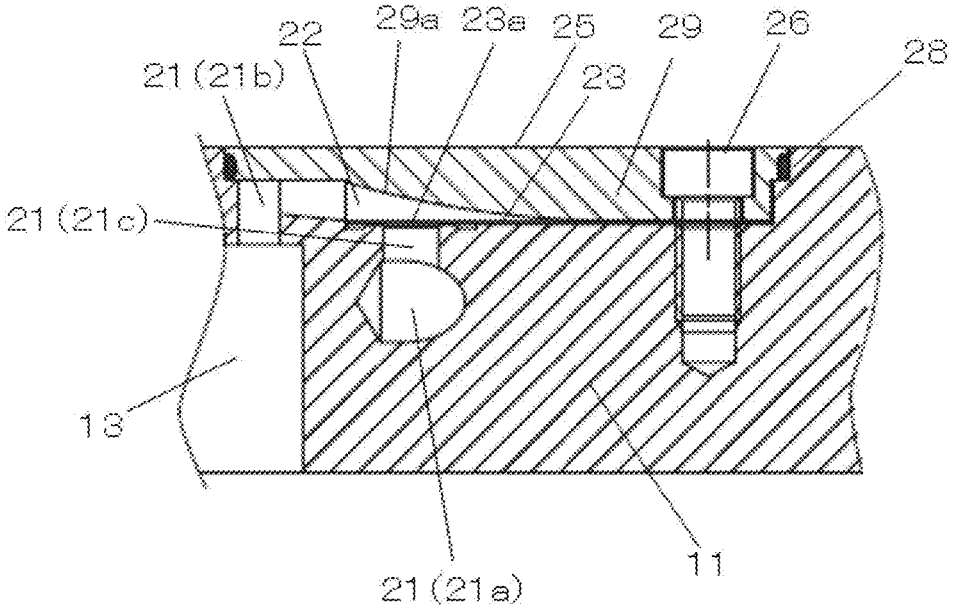

[Fig. 6]
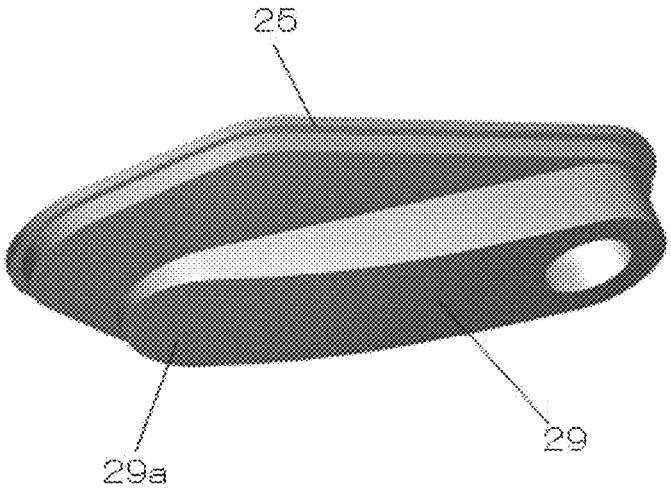

COMPRESSOR WITH INJECTION MECHANISM

TECHNICAL FIELD

The present invention relates to a compressor with an injection mechanism used in an injection cycle.

BACKGROUND TECHNIQUE

Patent document 1 shows a conventional compressor with a scroll injection mechanism used in an injection cycle. This injection mechanism of the compressor includes an injection passage which penetrates from an outer surface of a fixed scroll to a compressing chamber in a wall-thickness direction, a check valve chamber is formed on an outer face side of the injection passage, and a block having an injection pipe is assembled on an outer surface side of the check valve chamber such that a valve sheet which becomes a check valve is sandwiched between the check valve chamber and the block. A dead volume corresponding to an injection mechanism portion is reduced, efficiency degradation caused by re-expansion of compressed fluid or the like is suppressed, and efficiency is enhanced.

PRIOR ART DOCUMENT

Patent Document

[Patent Document 1] Japanese Patent Application Laid-open No. H11-107950

SUMMARY OF THE INVENTION

Problem to be Solved by the Invention

The present disclosure provides an efficient, reliable and inexpensive compressor with an injection mechanism without increasing a fixed scroll in size in which a structure of the injection mechanism is rationalized.

Means for Solving the Problem

In a compressor with an injection mechanism of the present disclosure, an injection passage radially connected from an outer circumferential surface of a fixed scroll to a compression chamber and a check valve chamber located halfway through the injection passage are formed in an involute extension angle extension side portion of a blade of the fixed scroll, the sheet-shaped check valve which opens and closes the injection passage is placed in the check valve chamber, an injection discharge passage connected to the compression chamber of the injection passage and the check valve chamber open from an outer surface of the fixed scroll, a lid body is attached to openings of the injection discharge passage and the check valve chamber such that the check valve is sandwiched between the openings and the lid body, and the injection discharge passage and the check valve chamber are hermetically closed by the lid body, thereby forming the injection passage in the fixed scroll.

Effect of the Invention

According to a compressor with an injection mechanism of the present disclosure, an injection passage and a check valve chamber are formed on an involute extension angle extension side portion of a blade which is a dead space of the blade of a fixed scroll, and a check valve is provided to constitute an injection mechanical portion. Hence, an entire length of a valve sheet which becomes a check valve of the injection mechanical portion can be increased without increasing the fixed scroll in size, an opening/closing stroke of the valve sheet can be increased, and flow of injection fluid can be smoothened. Efficiency of injection can be enhanced, and reliability of the valve sheet can be enhanced. Further, the injection mechanical portion can be assembled using the fixed scroll alone without attaching different parts such as a block having the injection pipe afterwards as in the conventional technique. Therefore, the assembling performance is enhanced, parts such as a muffler forming lid which is attached and fixed to an outer surface of the fixed scroll can be commoditized, and costs thereof can be lowered. Therefore, it is possible to provide a reliable, efficient and inexpensive compressor with an injection mechanism.

BRIEF DESCRIPTION OF DRAWINGS

FIG. 1 is a vertical sectional view of a compressor with an injection mechanism according to a first embodiment;

FIG. 2 is an enlarged sectional view showing a compressing mechanism portion of the compressor with the injection mechanism;

FIG. 3 is a plan view of a fixed scroll of the compressor with the injection mechanism;

FIG. 4 is an enlarged plan view showing essential portions of the fixed scroll of the compressor with the injection mechanism;

FIG. 5 is a sectional view taken along a line A-A in FIG. 4; and

FIG. 6 is a perspective view showing a lid body of the compressor with the injection mechanism in the first embodiment.

MODE FOR CARRYING OUT THE INVENTION (Knowledge which is a Basis of Present Disclosure)

When the present inventors achieved the present disclosure, there existed a scroll compressor with an injection mechanism described in patent document 1. According to the compressor with the injection mechanism, an injection passage is formed such that it penetrates an outer surface side of a fixed scroll to a compression chamber in a wall-thickness direction. A block having an injection pipe is assembled on an outer surface of the fixed scroll from which the injection passage opens. A sheet-shaped check valve such as a reed valve is sandwiched between the outer surface of the fixed scroll and the block. However, a screw hole for assembling the block must be formed in a thin end plate of a blade-opposed portion of the fixed scroll. Therefore it is necessary to increase thickness of the end plate of the blade-opposed portion, and there is a problem that the compressor is increased in size. Further, it is necessary to assemble the block having the injection pipe on a plane of the outer surface of the fixed scroll such that the reed valve is sandwiched between the block and the outer surface of the fixed scroll, and the block having the injection pipe exists on the outer surface of the fixed scroll. Hence, it is necessary to position or align the block and parts such as a muffler forming lid which is attached and fixed to the outer surface of the fixed scroll, and assembling performance is deteriorated, parts of the muffler forming lid and parts of the compressor with no injection mechanism cannot be commoditized, parts for exclusive use for the muffler forming lid are required and there is a problem that costs are increased.

Further, to enhance the efficiency of the injection, if the entire length of the sheet-shaped check valve is increased and the opening/closing stroke is increased and the flow of the injection fluid is smoothened, it is necessary to increase a volume of the check valve chamber which is recessed such that it opens into the outer surface side of the fixed scroll of the injection passage by the increased amount of the entire length of the check valve. Hence, there is a problem that a total volume of the injection passage which is connected to the compression chamber is adversely increased, the volume of the compressed fluid is largely expanded, and the efficiency of the compressor is deteriorated.

The present inventors found such problems, and configured a main subject of the present disclosure.

The disclosure provides an efficient, reliably and inexpensive compressor with an injection mechanism without increasing a fixed scroll in size in which a structure of the injection mechanism is rationalized.

An embodiment will be described below in detail with reference to the drawings. However, description which is detail more than necessary will be omitted in some cases. For example, detailed description of already well known matters, or redundant description of substantially the same configuration will be omitted in some cases. This is for preventing the following description from becoming redundant more than necessary, and for making it easy for a person skilled in the art to understand the present disclosure.

The accompanying drawing and the following description are provided so that a person skilled in the art can sufficiently understand the present disclosure, and it is not intended that they limit the subject matter described in claims.

First Embodiment

A first embodiment will be described below using FIGS. 1 to 6.

[1-1. Configuration]

FIG. 1 is a vertical sectional view of a compressor with a scroll injection mechanism according to the first embodiment of the disclosure, and FIG. 2 is an enlarged sectional view of essential portions showing a compressing mechanism portion shown in FIG. 1. A configuration and a function of the compressor with the injection mechanism according to the embodiment will be described below.

As shown in FIG. 1, the compressor with the injection mechanism according to the embodiment includes a hermetical container 1, a scroll compressing mechanism 2 incorporated in an interior one end-side of the hermetical container 1, a motor portion 3 for driving the compressing mechanism 2, and an oil pump 4 provided in an interior the other end-side bottom of the hermetical container 1. The oil pump 4 sends oil 6 in an oil reservoir 5 into a lubrication-requiring portion.

As shown in FIG. 2, the compressing mechanism 2 meshes a blade 11*a* standing up from an end plate 11*b* of the fixed scroll 11 and a blade 12*a* standing up from an end plate 12*c* of an orbiting scroll 12 with each other. The orbiting scroll 12 does not rotate but turns such that the orbiting scroll 12 circularly orbits. According to this, while a pair of compression chambers 13 formed between the fixed scroll 11 and the orbiting scroll 12 is moved from an outer circumferential side leading to a suction port 14 provided in the end plate 11*b* of the fixed scroll 11 toward a center side leading to a discharge port 15 provided in the end plate 11*b* of the fixed scroll 11, a sealed volume is reduced, and refrigerant is compressed and discharged out.

A supporting configuration of the fixed scroll 11, a driving configuration of the orbiting scroll 12, and a passage structure of compressed fluid which is sucked, compressed and discharged in the hermetical container 1 are not especially limited and any configurations and structure may be employed. The oil pump 4 is not especially limited and an oil pump of any type may be employed. In the compressing mechanism 2 of the first embodiment, the fixed scroll 11 is integrally provided, through a bolt, on the main bearing member 7*a* which is fixed to one end-side of the hermetical container 1 and the orbiting scroll 12 which is meshed with the fixed scroll 11 is sandwiched between the main bearing member 7*a* and the fixed scroll 11. As shown in FIG. 1, the motor portion 3 is composed of an annular stator 3*a* fixed to the hermetical container 1 through welding, and a rotor 3*b* placed inside of the stator 3*a*, and a crankshaft 8 which turns the orbiting scroll 12 of the compressing mechanism 2 is fixed to the rotor 3*b*.

A main shaft 8*b* of the crankshaft 8 is pivotally supported by the auxiliary bearing member 7*b* and the main bearing member 7*a* which are fixed to the hermetical container 1 through welding. An eccentric shaft 8*c* is provided at an end eccentric position of the main shaft 8*b*, and the eccentric shaft 8*c* and the orbiting scroll 12 are fitted to each other. If the main shaft 8*b* is rotated, the orbiting scroll 12 does not rotate but turns such that the orbiting scroll 12 circularly orbits with respect to the fixed scroll 11 by cooperation with an Oldham ring 16 provided between the main bearing member 7*a* and the orbiting scroll 12, and operation fluid in the compression chambers 13 is compressed.

A gas suction pipe 17 is connected to the suction port 14 of the compression chambers 13. Refrigerant gas compressed in the compression chambers 13 is discharged from the discharge port 15, and the refrigerant gas is discharged to outside from a gas discharging pipe 20 through a muffler chamber 19 formed by covering an upper outer surface of the fixed scroll 11 with a muffler forming lid 18 and through an upper space 1*a* of the hermetical container 1 which is in communication with the muffler chamber 19.

The oil pump 4 is driven by the crankshaft 8 together with the compressing mechanism 2. The oil 6 in the oil reservoir 5 is sent out to an oil passage 8*a* which vertically penetrates the crankshaft 8, and the oil 6 is supplied into the compressing mechanism 2 through gaps and predetermined passages, and remaining portion of the oil 6 is returned into the oil reservoir 5.

Devices such as a condenser, an expansion valve, a gas-liquid separator, a capillary tube, and a device for a freezing mechanism such as an evaporator (all not shown) are sequentially connected to one another from the gas discharging pipe 20 to the gas suction pipe 17, and they constitute a heat pump type refrigeration cycle in which all of the devices including the compressing mechanism 2 in the hermetical container 1 are annularly connected to one another. By such a refrigeration cycle, a cooling operation having low load and a heating operation having high load can be carried out, and for this purpose, they have a switching structure (not shown).

Next, a configuration of the injection mechanism will be described. FIG. 3 is a plan view of the fixed scroll 11, FIG. 4 is an enlarged plan view showing essential portions of the fixed scroll 11, i.e., the injection mechanical portion, FIG. 5 is a sectional view taken along a line A-A in FIG. 4, and FIG. 6 is a perspective view showing a lid body.

As shown FIGS. 3 and 4, an injection passage 21 which is radially connected to the compression chambers 13 from the outer circumferential surface of the end plate 11*b*, and the injection passage 21 injects gas. The check valve chamber 22 is formed in the involute extension angle extension side portion of the blade 11*a* of the fixed scroll is formed on the way to the injection passage 21 in the fixed scroll 11. The sheet-shaped check valve 23 composed of a reed valve is assembled in the check valve chamber 22.

The injection pipe 24 shown in FIGS. 1 and 2 is connected to the injection passage 21 through the check valve 23, and a gas refrigerant supply pipe (not shown) which branches off from the gas-liquid separator is connected to the injection pipe 24. According to this, gas refrigerant of gas-phase portion which is gas-liquid separated by the gas-liquid separator is injected into the compression chambers 13 through the gas refrigerant supply pipe, the injection pipe 24 and the injection passage 21, and the check valve 23 composed of the reed valve prevents the once injected refrigerant from reversely flowing. Such gas injection enhances the efficiency of the compressor in the compressing mechanism 2.

The gas may be injected in a timely manner in accordance with an operation state of the freezing device. To control the shutting down and releasing of the shutting down, a two-way solenoid valve (not shown) is provided on the way to the refrigerant supply pipe, and the freezing device is operated and control of the opening and closing operations is appropriately carried out. This control is carried out together with the control of operation of the freezing device by a microcomputer, but the controls are not limited to these.

To diversify the operation, in this embodiment, the motor portion 3 is inverter-controlled for example, and the orbiting scroll 12 can be turned and driven in a variable speed manner in addition to a heat pump type device which can be used for both cooling and heating operations.

The injection mechanism may have above-described configuration, but the present embodiment has the following configuration. That is, as shown in FIGS. 4 and 5 in the enlarged manner, an injection inlet passage 21*a* radially connected from the outer circumferential surface to the compression chambers 13 is formed in the fixed scroll 11, and the check valve chamber 22 is excavated in the injection inlet passage 21*a*. The check valve chamber 22 is integrally provided with an injection discharge passage 21*b* which connects the injection inlet passage 21*a* to the compression chambers 13. According to this, the injection passage 21 is configured.

The injection passage 21 and the check valve chamber 22 are formed in the involute extension angle extension side portion of the blade 11*a* of the fixed scroll 11. The check valve chamber 22 is in communication with the injection inlet passage 21*a* through an injection communication passage 21*c* formed in a wall-thickness direction of the fixed scroll 11. One end of the check valve chamber 22 on the side of the injection communication passage 21*c* is formed such that it intersects the injection inlet passage 21*a* at an acute angle, and the check valve chamber 22 opens such that it faces an outer surface of the fixed scroll 11 together with upper surfaces of the injection communication passage 21*c* and the injection discharge passage 21*b*.

A lid body 25 is attached to openings of upper surfaces of the check valve chamber 22, and the injection communication passage 21*c* and the injection discharge passage 21*b* such that the sheet-shaped check valve 23 is sandwiched between the openings of the upper surfaces and the lid body 25. The check valve 23 is composed of a reed valve which opens and closes the injection communication passage 21*c* of the check valve chamber 22.

The check valve 23 sandwiched by the lid body 25 is formed long and thin along the check valve chamber 22, one end of the check valve 23 is fastened and fixed to the fixed scroll 11 through a screw 26, and the other end of the check valve 23 is a valve portion 23*a* which opens and closes the injection communication passage 21*c*.

The lid body 25 is fixed to an outer surface of the fixed scroll 11 such that the lid body 25 is fitted into a shallow excavated recess 27 of a peripheral edge of the check valve chamber 22 through a seal member 28, and the lid body 25 shuts off and hermetically closes the upper openings of the check valve chamber 22, the injection communication passage 21*c* and the injection discharge passage 21*b* from outside. The lid body 25 of the embodiment is fitted into the check valve chamber 22 from the screw clamping portion of the one end of the check valve 23 to reduce a space which becomes a dead volume, and a valve guard 29 having a valve-stopping portion 29*a* which restricts a maximum opening angle of the check valve 23 is integrally formed on the lid body 25. A surface of the valve-stopping portion 29*a* against which the check valve 23 abuts is formed thin into an arc shape. The valve guard 29 may not integrally be formed on the lid body 25, and they may be formed as separated members. Further, as shown in FIG. 4, the seal member 28 is laterally symmetric with respect to a center line Z.

[1-2. Action]

Action and a function of the compressor with the injection mechanism of the above-described configuration will be described below.

In the compressor with the injection mechanism of the embodiment, if the injection is carried out, the check valve 23 is pushed and opened by injection pressure, and the injection is achieved. When the injection is not carried out, the check valve 23 is closed by its own restoring force, or fluid pressure caused by compression in the compression chambers 13 is added to the restoring force and the closing force is increased. Therefore, it is possible to prevent compressed fluid in the compression chambers 13 from exceeding the check valve 23 and from escaping toward the injection pipe 24, a function of the check valve is exhibited and the compression is achieved.

Here, the compressor with the injection mechanism forms the injection communication passage 21*c* and the check valve chamber 22 in the involute extension angle extension side portion of the blade which become the dead space of the blade 11*a* of the fixed scroll 11, and the check valve 23 is provided. Hence, as shown in FIG. 3, the entire length of the check valve 23 is increased while keeping an outer diameter of the fixed scroll 11 as it is, i.e., without increasing the outer diameter of the fixed scroll 11, and the opening/closing stroke can be increased. Therefore, it is possible to smoothen the flow of injection fluid such as refrigerant flowing through the injection communication passage 21*c* which becomes a valve seat of the check valve 23 without increasing the compressor in size, and it is possible to enhance the injection efficiency and compressor efficiency. Especially in this embodiment, since the valve-stopping portion 29*a* of the valve guard 29 which restricts the maximum opening position of the check valve 23 is formed into an arc shape, an opening angle of the tip end of the check valve 23 can be increased as compared with a case where the valve-stopping portion 29*a* is formed as a straight inclined surface. Therefore, flow resistance of the injection fluid can be reduced, and the injection efficiency can further be enhanced.

Further, by increasing the entire length of the check valve 23, a bending degree of the check valve 23 at the time of opening and closing motion can be gentle. Hence, if attempt is made to secure a similar flow rate of injection using a check valve sheet having a short entire length, it is possible to avoid adverse probabilities that the sheet is bent by acute bending, opening and closing motion is destabilized by bending habit, and the opening and closing motion can be stabilized and reliability can be enhanced. Especially in this embodiment, as described above, since the valve-stopping portion 29*a* of the valve guard 29 which restricts the maximum opening position of the check valve 23 is formed into the arc shape, it is possible to reduce the stress applied to the bending deforming starting point of the check valve 23 as compared with the case where the valve-stopping portion 29*a* is formed into the straight inclined surface. Hence, it is possible to effectively reduce the generation of bending of the sheet and the bending habit, and the reliability can be enhanced.

In this embodiment, the dead space is eliminated by fitting the valve guard 29 into the dead space portion other than the opening/closing stroke space of the check valve of the long and thin check valve chamber 22 which is required to increase the entire length of the check valve 23. Therefore, it is possible to reduce the injection passage volume including the check valve chamber 22, i.e., it is possible to reduce the dead volume to the minimum necessary. Therefore, it is possible to effectively suppress the efficiency deterioration caused by re-expansion of the compressed fluid, and efficiency of the compressor can be enhanced. That is, when gas injection which is carried out in the high load operation at the time of the heating operation due to diversification of the compressor operation is not carried out in the low load operation at the time of the cooling operation, even if refrigerant or lubricant oil in the dead volume is re-expanded, it is possible to reduce its influence, and efficiency and performance of the compressor in the low load operation can be enhanced. Further, even if lubricant oil enters the dead volume, since the amount of lubricant oil is small, it is possible to reduce the deterioration of lubricating performance of the sliding portion of the compressing mechanism 2, and it is possible to prevent the performance and reliability from being deteriorated.

In this embodiment, the seal member 28 is provided on fitting surfaces between the lid body 25 and the fixed scroll 11 which close the upper surface openings of the check valve chamber 22, the injection communication passage 21*c* and the injection discharge passage 21*b*. Therefore, it is possible to prevent high pressure refrigerant gas from leaking into the injection passage 21 which is composed of the check valve chamber 22, the injection communication passage 21*c* and the injection discharge passage 21*b*. Hence, it is possible to provide a more efficient compressor with the injection mechanism.

The injection mechanical portion including the check valve function is constituted such that outer surface of the fixed scroll 11 is excavated to form the check valve chamber 22, the injection communication passage 21*c* and the injection discharge passage 21*b*, and upper surface openings thereof are hermetically closed with the lid body 25. Therefore, the injection mechanical portion is composed of the fixed scroll 11 only. Hence, the injection mechanical portion can be assembled only from the fixed scroll without assembling the block having the injection pipe later unlike the conventional technique, and it is possible to enhance the assembling performance, i.e., productivity. Further, the valve-stopping portion 29*a* which becomes valve-stopping when the check valve is opened or closed is integrally formed on the lid body 25. Therefore, it is unnecessary to separately assemble the lid body 25 and the valve-stopping portion 29*a*, and it is possible to further enhance the productivity. In addition, the seal member 28 of the lid body 25 which closes the upper surface openings of the check valve chamber 22, the injection inlet passage 21*a* and the injection discharge passage 21*b* is laterally symmetric with respect to the center line. Therefore, when the seal member 28 is assemble to an excavated recess 27 in an outer surface of the fixed scroll 11, cumbersome labor to align an orientation of the seal member 28 is not required, and it is possible to further enhance the productivity.

In addition, a portion which fixes, using a screw, the lid body 25 fixed to the upper surface openings of the check valve chamber 22, the injection communication passage 21*c* and the injection discharge passage 21*b* using the screw is a portion having not blade configuration of the involute extension angle extension side portion. Therefore, when a screw hole is formed for fixing the lid body 25 using the screw, it is unnecessary to thicken the end plate of the fixed scroll 11, and it is possible to prevent the fixed scroll 11 from becoming large.

In this embodiment, since a block having an injection pipe does not exist on the outer surface of the fixed scroll 11, a muffler forming lid 18 which is attached and fixed to the outer surface of the fixed scroll 11 and a muffler forming lid having no injection mechanism can be commoditized, costs can be reduced because the productivity is enhanced and in addition, this, it is possible to further reduce the costs.

[1-3. Effect and the Like]

As described above, according to the compressor with the injection mechanism of the present disclosure, an injection passage 21 radially connected from an outer circumferential surface of the fixed scroll 11 to the compression chamber 13 and a check valve chamber 22 located halfway through the injection passage 2 are formed in an involute extension angle extension side portion of a blade 11*a* of the fixed scroll 11, the sheet-shaped check valve 23 which opens and closes the injection passage 21 is placed in the check valve chamber 22, an injection discharge passage 21*b* connected to the compression chamber 13 of the injection passage and the check valve chamber 22 open from an outer surface of the fixed scroll 11, a lid body 25 is attached to openings of the injection discharge passage 21*b* and the check valve chamber 22 such that the check valve 23 is sandwiched between the openings and the lid body 25, and the injection discharge passage 21*b* and the check valve chamber 22 are hermetically closed by the lid body 25, thereby forming the injection passage 21 in the fixed scroll 11. Therefore, it is possible to provide an efficient, reliable and inexpensive compressor with an injection mechanism without increasing the fixed scroll 11 in size.

That is, the injection passage 21 and the check valve chamber 22 are formed in the involute extension angle extension side portion of the blade 11*a* which is a dead space of the blade 11*a* of the fixed scroll 11, the valve sheet is provided to constitute the injection mechanical portion. Therefore, the entire length of the valve sheet which becomes the check valve 23 of the injection mechanical portion can be increased without increasing the fixed scroll 11 in size, and opening/closing stroke of the valve sheet can be increased, the efficiency can be enhanced and reliability can also be enhanced. Further, the injection mechanical portion can be assembled using the fixed scroll alone without mounting another part such as a block having an injection pipe. Therefore, the assembling performance is enhanced, parts such as a muffler forming lid 18 and the like which are attached and fixed to the outer surface of the fixed scroll 11 can be commoditized, and costs can be reduced. Therefore, it is possible to provide a reliable, efficient and inexpensive compressor with an injection mechanism.

Further, in the scroll compressor, if the valve guard 29 of the check valve 23 for opening and closing the injection passage is integrally provided on the lid body 25, a dead volume of the injection passage 21 can be reduced in size to the minimum, and efficiency deterioration caused by re-expansion of compressed fluid can effectively be suppressed. Therefore, efficiency of the compressor can further be enhanced.

Further, in the scroll compressor, if a seal member 28 is provided on fitting surfaces of the fixed scroll 11 and the lid body 25, it is possible to prevent leakage of high pressure refrigerant gas into the injection passage 21. Therefore, it is possible to provide an efficient compressor with an injection mechanism.

Further, in the scroll compressor, if the seal member 28 of the lid body 25 is laterally symmetric, it becomes easy to attach the seal member 28, and the productivity can further be enhanced.

The embodiment of the technique in the present disclosure has been described above, the embodiment shows the technique in the disclosure as an example, various changes, replacement, addition, omission and the like may be made in claims or equivalent scopes.

INDUSTRIAL APPLICABILITY

The present invention provides an efficient, reliable and inexpensive compressor with an injection mechanism without increasing a fixed scroll in size. Therefore, the invention is useful for a freezing device of an air conditioner or a refrigerator, and for a heat pump type hot water supply system.

EXPLANATION OF SYMBOLS

1 hermetical container
1*a* upper space
2 compressing mechanism
3 motor portion
3*a* stator
3*b* rotor
4 oil pump
5 oil reservoir
6 oil
7*a* main bearing member
7*b* auxiliary bearing member
8 crankshaft
8*a* oil passage
8*b* main shaft
8*c* eccentric shaft
11 fixed scroll
11*a* blade
11*b* end plate
12 orbiting scroll
12*a* blade
12*c* end plate
13 compression chamber
14 suction port
15 discharge port
16 Oldham ring
17 gas suction pipe
18 muffler forming lid
19 muffler chamber
20 gas discharging pipe
21 injection passage
21*a* injection inlet passage
21*b* injection discharge passage
21*c* injection communication passage
22 check valve chamber
23 check valve
23*a* valve portion
24 injection pipe
25 lid body
26 screw
27 excavated recess
28 seal member
29 valve guard
29*a* valve-stopping portion

The invention claimed is:

1. A compressor with an injection mechanism, the compressor comprising:

a sealed volume, wherein the sealed volume is reduced by a change of a location of a compression chamber from a suction port to a discharge port, wherein for the compressor to compress fluid sucked in the suction port to discharge the fluid to outside in the discharge port, the fluid to be compressed is injected into the compression chamber through a sheet-shaped check valve, wherein the compression chamber is formed between a fixed scroll and an orbiting scroll, an injection passage connected to the compression chamber is formed in the fixed scroll, the injection passage is formed radially from an outer circumferential surface of the fixed scroll, the injection passage is formed by an injection inlet passage, an injection communication passage, and an injection discharge passage, one end of a check valve chamber on the side of the injection communication passage is formed such that the check valve chamber intersects the injection inlet passage at an acute angle, the injection passage and the check valve chamber are formed in an involute extension angle extension side portion of a blade of the fixed scroll in which the compression chamber is formed, the check valve chamber is present between the injection passage and the suction port, the check valve chamber, the injection communication passage, and the injection discharge passage open to face an outer surface of the fixed scroll, a lid body is attached to openings of upper surfaces of the check valve chamber, the injection communication passage, and the injection discharge passage such that the sheet-shaped check valve is sandwiched between the lid body and the openings of the upper surfaces of the check valve chamber, the injection communication passage, and the injection discharge passage, the sandwiched sheet-shaped check valve is long and thin and is formed along the check valve chamber, one end of the sheet-shaped check valve is fastened to the fixed scroll through a screw, the other end of the sheet-shaped check valve is a valve portion that opens and closes the injection communication passage, the lid body shuts off and hermetically closes the openings of the upper surfaces of the check valve chamber, the injection communication passage, and the injection discharge passage from outside.

2. The compressor with the injection mechanism according to claim 1, wherein the lid body is integrally provided with a valve guard for the sheet-shaped check valve to open and close the injection passage.

3. The compressor with the injection mechanism according to claim 1 wherein a seal member is provided on fitting surfaces of the fixed scroll and the lid body.

4. The compressor with the injection mechanism according to claim 3, wherein the seal member of the lid body is laterally symmetric with respect to a center line Z of the lid body.

* * * * *